US009921594B1

(12) United States Patent
Kovac et al.

(10) Patent No.: US 9,921,594 B1
(45) Date of Patent: Mar. 20, 2018

(54) LOW DROPOUT REGULATOR WITH THIN PASS DEVICE

(71) Applicant: Peregrine Semiconductor Corporation, San Diego, CA (US)

(72) Inventors: David Kovac, Arlington Heights, IL (US); Joseph Golat, Crystal Lake, IL (US)

(73) Assignee: pSemi Corporation, San Diego, CA (US)

( * ) Notice: Subject to any disclaimer, the term of this patent is extended or adjusted under 35 U.S.C. 154(b) by 0 days.

(21) Appl. No.: 15/487,299

(22) Filed: Apr. 13, 2017

(51) Int. Cl.

| | |
|---|---|
| ***G05F 1/565*** | (2006.01) |
| ***G05F 3/24*** | (2006.01) |
| ***G05F 1/575*** | (2006.01) |
| ***G05F 1/46*** | (2006.01) |
| ***G05F 1/585*** | (2006.01) |
| ***G05F 1/595*** | (2006.01) |
| ***G05F 3/22*** | (2006.01) |

(52) U.S. Cl.
CPC ..... *G05F 1/565* (2013.01); *G05F 1/462* (2013.01); *G05F 1/575* (2013.01); *G05F 1/585* (2013.01); *G05F 1/595* (2013.01); *G05F 3/222* (2013.01); *G05F 3/242* (2013.01)

(58) Field of Classification Search
CPC ..... G05F 1/565; G05F 1/575; G05F 1/595; G05F 1/585; G05F 3/222
See application file for complete search history.

(56) References Cited

U.S. PATENT DOCUMENTS 4,651,409 A 3/1987 Ellsworth et al.
5,920,486 A 7/1999 Beahm et al.
(Continued)

OTHER PUBLICATIONS

Nihu, David, Office Action received from the USPTO dated May 21, 2014 for U.S. Appl. No. 13/826,566, 6 pgs.
(Continued)

*Primary Examiner* — Yusef Ahmed
(74) *Attorney, Agent, or Firm* — Jaquez Land Greenhaus LLP; Martin J. Jaquez, Esq.; Alessandro Steinfl, Esq.

(57) ABSTRACT

Systems, methods and apparatus for efficient control and biasing of pass devices that include at least one thin pass device and a remaining of thick pass devices. When operated at extreme high and low voltages, the at least one thin pass device maintains operation in its saturation region of operation while the remaining pass devices may be driven into their triode regions of operation. The thin and thick pass devices are arranged in a cascode configuration that includes a plurality of stacked devices. Biasing of the thin and thick cascode devices can be according to a voltage division scheme which protects the devices when the voltage across the stack is high, and provides a skewed voltage division across the stacked devices that promotes a higher gate-to-source voltage of the thick pass devices for a lower $R_{ON}$. In one exemplary case, gate length of the at least one thin pass device may be reduced to provide a lower gate-to-source voltage of the thin pass device during operation in the saturation region. An exemplary implementation of an LDO controlling the pass devices for providing RF power to a power amplifier is described.

21 Claims, 12 Drawing Sheets

(56) References Cited

U.S. PATENT DOCUMENTS

| | | | | |
|---|---|---|---|---|
| 6,465,994 | B1 * | 10/2002 | Xi | G05F 1/575 323/274 |
| 6,703,813 | B1 * | 3/2004 | Vladislav | G05F 1/575 323/270 |
| 6,804,502 | B2 | 10/2004 | Burgener et al. | |
| 7,248,120 | B2 | 7/2007 | Burgener et al. | |
| 7,910,993 | B2 | 3/2011 | Brindle et al. | |
| 8,487,706 | B2 | 7/2013 | Li et al. | |
| 8,987,792 | B2 | 3/2015 | Adamski et al. | |
| 9,184,709 | B2 * | 11/2015 | Adamski | H03F 3/2176 |
| 9,331,643 | B2 * | 5/2016 | Gaynor | H03F 3/193 |
| 2003/0111985 | A1 * | 6/2003 | Xi | G05F 1/575 323/273 |
| 2005/0040799 | A1 * | 2/2005 | Pannwitz | G05F 1/575 323/282 |
| 2011/0043284 | A1 * | 2/2011 | Zhao | H03F 1/0283 330/277 |
| 2011/0181360 | A1 | 7/2011 | Li et al. | |
| 2014/0184336 | A1 * | 7/2014 | Nobbe | H03F 1/0227 330/296 |
| 2014/0264625 | A1 | 9/2014 | Adamski et al. | |
| 2014/0266105 | A1 * | 9/2014 | Li | G05F 1/565 323/280 |
| 2017/0126180 | A1 * | 5/2017 | Bakalski | H03F 1/0261 |
| 2017/0133989 | A1 * | 5/2017 | Dykstra | H03F 1/3205 |
| 2017/0302230 | A1 * | 10/2017 | Lehtola | H03F 1/30 |
| 2017/0317625 | A1 * | 11/2017 | Vera | G05F 1/595 |

OTHER PUBLICATIONS

Nihu, David, Office Action received from the USPTO dated Aug. 6, 2014 for U.S. Appl. No. 13/826,566, 9 pgs.

Nihu, David, Notice of Allowance received from the USPTO dated Nov. 14, 2014 for U.S. Appl. No. 13/826,566, 7 pgs.

Adamski, et al., Response to Restriction Requirement filed in the USPTO dated Jul. 16, 2014 for U.S. Appl. No. 13/826,566, 3 pgs.

Adamski, et al., Response filed in the USPTO dated Nov. 5, 2014 for U.S. Appl. No. 13/826,566, 7 pgs.

Jeong, J. et al. "A 20 dBm Linear RF Power Amplifier Using Stacked Silicon-on-Sapphire MOSFETs." IEEE Microwave and Wireless Compenents Letters, vol. 16 (12), Dec. 2006, pp. 684-686.

Apostolidou, M. et al. "A 65nm CMOS 30dBm Class-E RF Power Amplifier with 60% Power Added Efficiency." IEEE Radio Frequency Integrated Circuits Symposium, 2008, pp. 141-144.

* cited by examiner

PRIOR ART FIG. 2

LOW DROPOUT REGULATOR WITH THIN PASS DEVICE

CROSS-REFERENCE TO RELATED APPLICATIONS

The present application may be related to U.S. Pat. No. 8,987,792 B2, entitled "Merged Active Devices on a Common Substrate", issued Mar. 24, 2015, the disclosure of which is incorporated herein by reference in its entirety.

TECHNICAL FIELD

The present application generally relates to electronic circuitry, and more specifically to low dropout (LDO) regulators using thin pass devices.

BACKGROUND

A low dropout (LDO) regulator can be used to provide regulated power to an electronic device at a level close to a level of a power source provided to the LDO regulator. FIG. 1 shows an exemplary prior art case where an LDO regulator (110) is used to provide power to a load (180) based on a power source Vbatt. The LDO regulator (110) comprises an operational amplifier (115) whose output is connected to a current driver circuit (120) capable of handling current into the load (180) based on a desired output voltage of the LDO regulator, LDO_out. Such output voltage, LDO_out, is sampled through, for example, a voltage division network formed by resistors (R1, R2) and fed back to the positive input terminal of the operational amplifier (115), to create a closed loop control of the output voltage LDO_out such as to track an input voltage fed to the inverting input terminal of the operational amplifier (OpAmp) (115). In the described closed loop mode of operation, the LDO regulator (110) regulates the output voltage LDO_out to remain substantially constant irrespective of the current required by the load (180) during operation. When in regulation, the output voltage LDO_out is based on the voltage Vramp input to the operational amplifier (115). By varying the voltage Vramp, the output voltage LDO_out varies in a substantially linear manner so long as the LDO regulator (110) is capable of operating in the closed loop mode.

With further reference to FIG. 1, the current driver circuit (120) can comprise one or more transistor devices, (101, 102), arranged as a cascode stack, including an input transistor (101) and one or more cascode transistors (102). In the LDO configuration depicted in FIG. 1, transistors (101, 102) are also referred to as pass devices or pass transistors, such as P-type MOSFETs (PMOS), which during regulation of the output voltage, LDO_out, may operate in their respective saturation regions of operation and can therefore provide a corresponding high enough gain for operation of the above described closed loop control. A person skilled in the art would know that regulation of the output voltage, LDO_out, may also be provided via operation of the cascode device (102) in its triode region so long as the input transistor (101) operates in its saturation region of operation to provide a high enough gain for closed loop operation (regulation). Biasing of the pass devices may be according to a voltage withstand capability of the pass devices in view of a high voltage across the pass devices, such high voltage being based on a voltage range of Vramp and a voltage range of the power source Vbatt.

As known to a person skilled in the art, the pass devices (101, 102) of the current driver circuit (120) can contribute to a power loss, which in some cases, such as during operation of the LDO regulator with a low voltage across the pass devices, may be a disadvantage. Such power loss in the pass devices may be reduced by driving the pass devices into their respective triode (linear) regions of operation by applying a corresponding biasing voltage to the gates of the pass devices. However, when driven into their respective triode regions of operation, the pass devices have a very low gain which can cause the LDO to operate in essentially an open loop mode where the input voltage is not tracked and therefore the LDO_out voltage is not regulated. It can be desirable to avoid, or delay, operation of the pass devices in their respective triode regions during the low voltage operation while maintaining a reduced power loss through the pass devices, and protecting the pass devices during the high voltage operation as described in the following paragraphs. This can allow maintaining regulation at higher output power given a same total size of the pass devices.

SUMMARY

According to a first aspect of the present disclosure, a circuital arrangement is presented, the circuital arrangement comprising: a stack of at least two transistors arranged in a cascode configuration, comprising an input transistor with a thin gate oxide layer and a first cascode transistor with a thick gate oxide layer; and a biasing circuit configured to provide a first bias voltage to the first cascode transistor, wherein a supply voltage to the stack is a varying supply voltage, and the first bias voltage is a function of the varying supply voltage and an output voltage at an output of the stack.

According to a second aspect of the present disclosure, a method for adjusting a bias voltage of a cascode transistor is presented, the method comprising: providing a stack of at least two transistors arranged in a cascode configuration, comprising an input transistor with a thin gate oxide layer and a first cascode transistor with a thick gate oxide layer; biasing the first cascode transistor based on a varying supply voltage to the stack and an output voltage of the stack; and based on the biasing, providing an unequal division of the varying supply voltage across the stack.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference numbers and designations in the various drawings indicate like elements.

DETAILED DESCRIPTION

Figure 1:
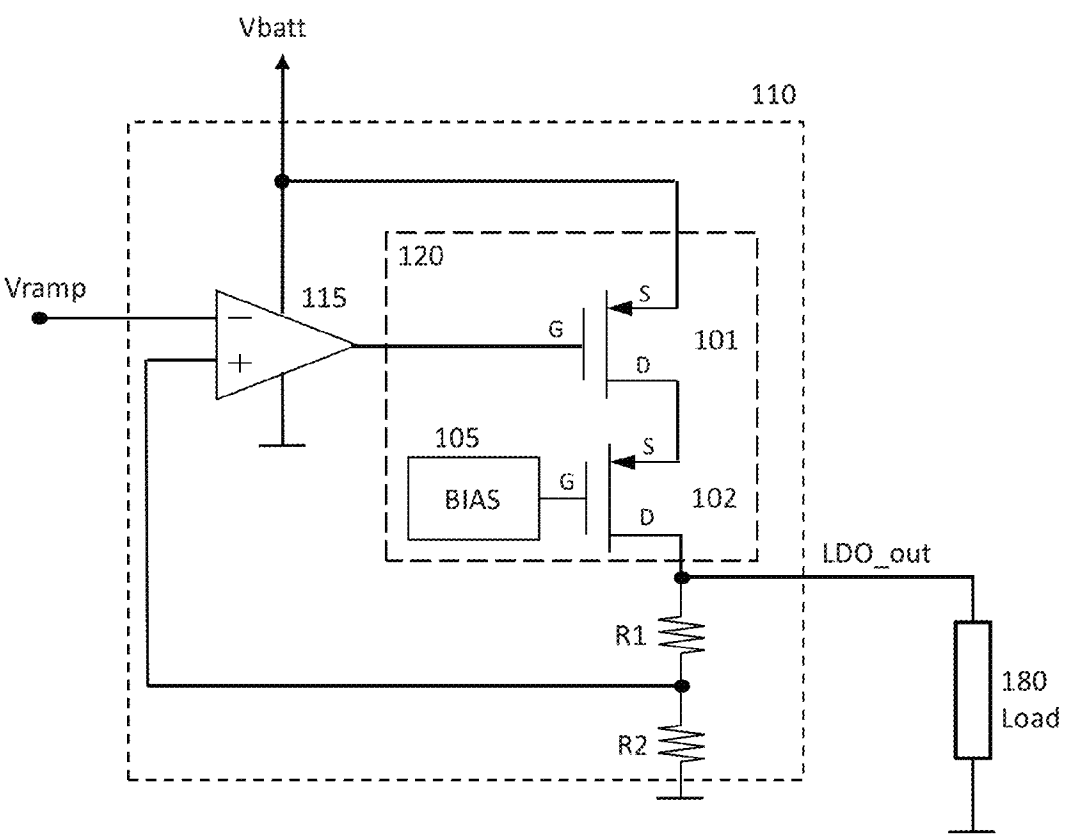
FIG. 1 PRIOR ART
FIG. 1 is a simplified schematic representation of a prior art LDO regulator used to provide power to a load. Thick pass devices (101, 102) are used to provide a current required by the load. The LDO regulator controls the power to the load based on a control voltage, Vramp, and a supply voltage (Vbatt). A biasing circuit is used to bias the pass devices.

As shown in the prior art configuration of FIG. 1, an LDO regulator (110) can be used to control power to a load (180). The LDO regulator comprises a low power OpAmp (115) which drives a high current pass device (101) to provide power to the load (180). An additional second pass device (102) can be used in a cascode configuration to allow for a larger voltage drop across the combination of the pass devices (101, 102), wherein the larger voltage drop can be substantially equal to the voltage of the supply Vbatt (e.g. nominal supply voltage of 3.5 volts for a handheld cell phone). According to some embodiments, the pass devices can be in a cascode configuration with a dedicated biasing circuit (105) for biasing the additional device.

The person skilled in the art readily understands that, based on the supply voltage, Vbatt, two or more pass devices configured in a series connection as depicted in FIG. 1 may be used. As a voltage across the pass devices may be as high as the supply voltage, the two or more pass devices can be used to distribute the supply voltage across the pass devices such as no pass device is subjected to a voltage beyond its voltage withstand capability. As known to the person skilled in the art, due to the cascode configuration of the pass devices (101, 102), biasing of the (cascode) pass device (102) not driven by the OpAmp (115) is controlled by the pass device (101) in combination with the biasing circuit (105).

Figure 2:
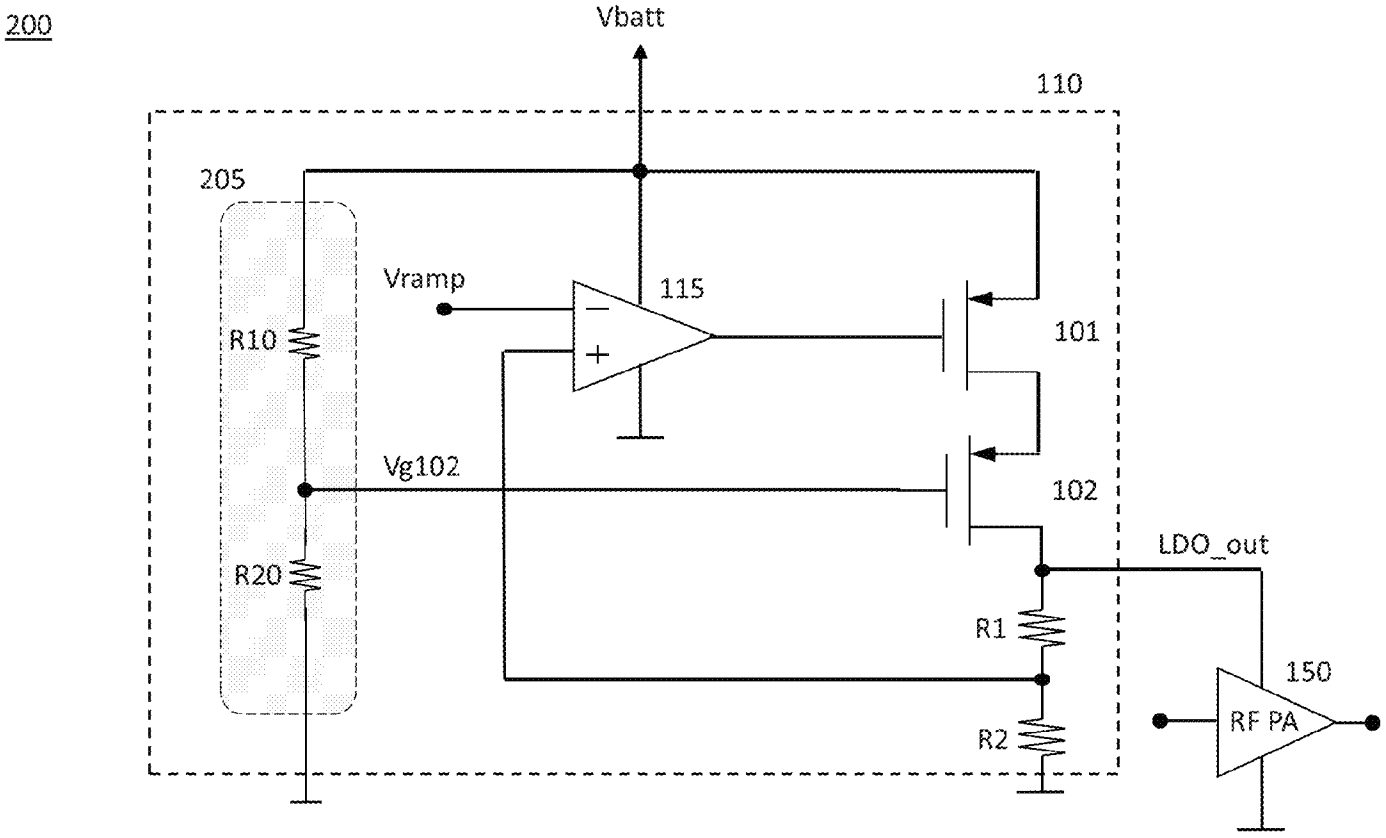
FIG. 2 is an alternative configuration of the prior art regulator depicted in FIG. 1, wherein the load is an RF amplifier, and the biasing circuit is a resistive voltage divider.

FIG. 2 shows an exemplary prior art configuration of the LDO regulator (110) depicted in FIG. 1, where the biasing circuit (105) is replaced with a simple biasing circuit (205) comprising two resistors (R10, R20) configured as a voltage divider network to provide a fixed gate voltage, based on the supply voltage Vbatt, to the gate of the pass device (102). In one exemplary nonlimiting case, such fixed gate voltage may be ⅓*Vbatt. A person skilled in the art would understand that such simple biasing circuit (205) may inherently impose limits to a biasing voltage for the pass device (102) responsive to a variation of the supply voltage Vbatt, which can therefore limit a low value of an $R_{ON}$ resistance of such pass device, and therefore contribute to an undesired power loss through the device. Some prior art implementations may reduce such power loss by driving the pass devices into their respective triode (linear) regions of operation to obtain lower $R_{ON}$ resistance. However, when driven into their respective triode regions of operation, the pass devices have a very low gain (e.g. lower transconductance $g_m$) which can cause the LDO regulator (110) to operate essentially in open loop mode wherein the input voltage, Vramp, is not tracked and therefore the LDO_out voltage is not regulated. The teachings according to the present disclosure can be used to maintain regulation of the LDO_out voltage throughout a desired output voltage range, while maintaining a low $R_{ON}$ of the pass devices for a reduced power loss in the pass devices.

As can be seen in the exemplary prior art configuration depicted in FIG. 2, the load to the LDO regulator may be a radio frequency (RF) power amplifier (PA) (150), which can be used, for example, to generate RF power in a GSM system, where a burst of RF power is controlled by the LDO_out voltage that varies between a low voltage corresponding to essentially no power, and a high voltage that corresponds to maximum power. In some exemplary nonlimiting embodiments, the LDO_out voltage can vary between 0 volts and 3.4 volts, which in turn can result in an RF output power within a range of approximately [−54, 35] dBm for Low Band GSM operation. It should be noted that the lowest voltage level of the LDO_out voltage combined with a high voltage level of the supply voltage Vbatt can determine a minimum number of the cascode pass transistors (101, 102) necessary to withstand a corresponding voltage drop across such transistors. In some exemplary nonlimiting embodiments, the supply voltage Vbatt can have a high voltage level of about 4.5 volts, which means that a high voltage across the pass transistors may be as high as 4.5 volts in a case where the LDO_out voltage is 0 volts.

With further reference to FIG. 2, the LDO_out voltage that controls the RF power to the RF PA (150) is controlled by the Vramp control voltage fed to the inverting input of the OpAmp (115). In one exemplary nonlimiting embodiment, the Vramp is within a range of [0, 1.6] volts which corresponds to a scale factor of approximately 3.4/1.6 with respect to the LDO_out voltage for a case where the supply voltage Vbatt is 3.4 volts. Such scale factor can be provided by the resistors R1, R2 which divide the LDO_out voltage accordingly.

In order to achieve higher efficiency and higher power in the prior art configuration of FIG. 2 (as well as FIG. 1), it may be desirable to minimize loss in the pass devices (101, 102) at full power (e.g. LDO_out at its high value, and voltage drop across the pass devices at its low value). As mentioned above, such higher efficiency and power can be achieved by driving the pass devices (101, 102) into their respective triode regions of operation in which the pass devices exhibit a very small $R_{ON}$ resistance (between source and drain). According to some prior art embodiments, the size (e.g. width) of the pass device (101, 102) can be made large enough to reduce the size of the corresponding $R_{ON}$ resistance when operating in the triode region for a lower power consumption of the pass device, and therefore higher operating efficiency and higher power of the RF PA (150). As the current at full power drawn by the RF PA (150) from the supply Vbatt can be up to 2 amps (and beyond), a target $R_{ON}$ of 100 mΩ or less can be desirable in order to reduce the loss in the pass devices (101, 102) and maximize efficiency of the RF PA (150) at maximum RF power. In turn, this can allow the prior art LDO configuration to provide a higher current to the load while operating in open loop. In contrast, teachings according to the present disclosure described below allow the LDO to provide such higher current while maintaining regulation using a combination of thin and thick pass devices with a total pass device width (combined width of all the pass devices) similar to the total pass device width of the prior art configuration (and therefore a same physical layout area for the two configurations). A person skilled in the art is well versed in transistor technology and physical properties, including a width and a (gate) length of the transistor, and corresponding impact on performance parameters of the transistor.

As known to a person skilled in the art, active devices (e.g. transistors) can be stressed by their operating conditions. This stress can reduce the operating lifetime or reliability of the device. Examples of stress for a CMOS device include Hot Carrier Injection (HCI) and Time Dependent Dielectric Breakdown (TDDB). TDDB is a voltage stress on the gate oxide which results in the formation of a conduction path through the gate oxide. It is primarily a function of the stressing voltage, time, and temperature. It can be affected by DC and RF conditions. HCI results from carriers with high kinetic energy from the electric field being injected into regions such as the gate oxide. These trapped carriers then affect device parameters such as the threshold voltage, which leads to a change in current conduction. The effects are cumulative. HCI is a function of the voltage and current conditions that result from DC and RF operation.

With further reference to the prior art configurations depicted in FIG. 1 and FIG. 2, in order to limit stress due to a higher voltage applied to the pass devices (101, 102), such as in the case of minimum output power where the LDO_out voltage is at its minimum value, substantially equal to 0 volts, the pass devices are configured as "thick" devices. A person skilled in the art is well aware of a distinction in a performance of such thick device when compared to a "thin" device, as a thicker gate oxide layer of the thick device can allow for a higher voltage applied to the pass device, and therefore lower stress, when compared to a thinner gate oxide layer of the thin device. In one exemplary nonlimiting case, thickness of the pass devices may be designed according to a substantially equal division of a high voltage of the supply voltage, Vbatt, across the pass devices. Alternatively, the thick devices may be designed for an unequal division of the high voltage of the supply voltage, Vbatt, across the pass devices. By limiting stress due to the high voltage across the pass devices, related effects, such as, HCI and TDDB may be controlled.

It should be noted that, as known to a person skilled in the art, current MOSFET fabrication processes may allow for dual gate oxide thicknesses, where a "thick" gate oxide layer may provide a relatively thicker (e.g. 70 angstroms or greater) gate oxide layer thickness together with a relatively longer (e.g. 0.30 μm or longer) minimum gate length, and where a "thin" gate oxide thickness may provide a relatively thinner (e.g. 30 angstroms or smaller) gate oxide layer thickness together with a relatively shorter (e.g. 0.13 μm or shorter) minimum gate length. Therefore, in a practical fabrication standpoint, in a "dual-gate-oxide" process, one may associate a thin device with a device having a relatively shorter minimum gate length and a relatively thinner gate oxide thickness than a thick device. The teachings according to the present disclosure take advantage of the gate length and the gate oxide layer thickness independent of one another.

Based on the above, and LDO regulator, such as per the prior art configurations depicted in FIG. 1 and FIG. 2, is designed to address two critical operating conditions. A first critical operating condition corresponds to a case where the LDO_out voltage is at its low voltage level (e.g. Vramp=0 V), substantially equal to 0 volts, and the supply voltage Vbatt is at its high voltage level (e.g. 4.5 volts for a fully charged battery), which therefore corresponds to a high voltage applied across the pass devices (101, 102). Effects of such high voltage in stressing of the pass devices during the first critical operating condition need to be addressed. The prior art configurations depicted in FIG. 1 and FIG. 2 address such first critical condition by designing a thickness of the (thick) pass devices (101, 102) accordingly and bias the pass device (102) such as to protect the pass devices (101, 102) from excessive voltage (e.g. beyond their respective voltage withstand capabilities). As the high voltage may equally be divided across the two pass devices (101, 102), the pass devices of the prior art configurations may have a substantially same thickness. A second critical operating condition corresponds to a case in which the LDO_out voltage is at its high voltage level (e.g. full power) and the supply voltage Vbatt is at its nominal value (e.g. 3.5 volts), which therefore corresponds to a low voltage applied across the pass devices (101, 102). In this second critical condition, for a given total size of the pass devices (101, 102), a minimum required low voltage applied across the pass devices (101, 102) to maintain the LDO in regulation may limit a load current through the pass devices as well as the high voltage level of the LDO_out voltage. In this second critical operating condition, there may be a desire to maximize the high voltage level of the LDO_out voltage for a given total size of the pass devices, which some prior art configurations address by pushing the pass devices (101, 102) into their respective triode regions of operation for a lower $R_{ON}$ and therefore a lower power loss through the pass devices and a higher LDO_out voltage, at the cost of running the LDO regulator (110) in open loop. A person skilled in the art would know that as the gain (i.e. transconductance $g_m$) of the pass devices decrease, by virtue of operation of the pass devices in their respective triode regions of operation, the LDO regulator may not operate in the closed loop mode for regulation of the LDO_out voltage. Alternatively, the prior art configurations depicted in FIG. 1 and FIG. 2, may address the second critical operating condition by increasing a width (size) of the pass devices (101, 102) to reduce their $R_{ON}$ at the cost of increase in circuit layout area and increase gate capacitance of the pass devices. Teachings according to the present disclosure allow the LDO to provide a higher load current while maintaining regulation at a higher LDO_out voltage using a combination of thin and thick pass devices with a total pass device width similar to the total pass device width of the prior art configuration.

Figure 3:
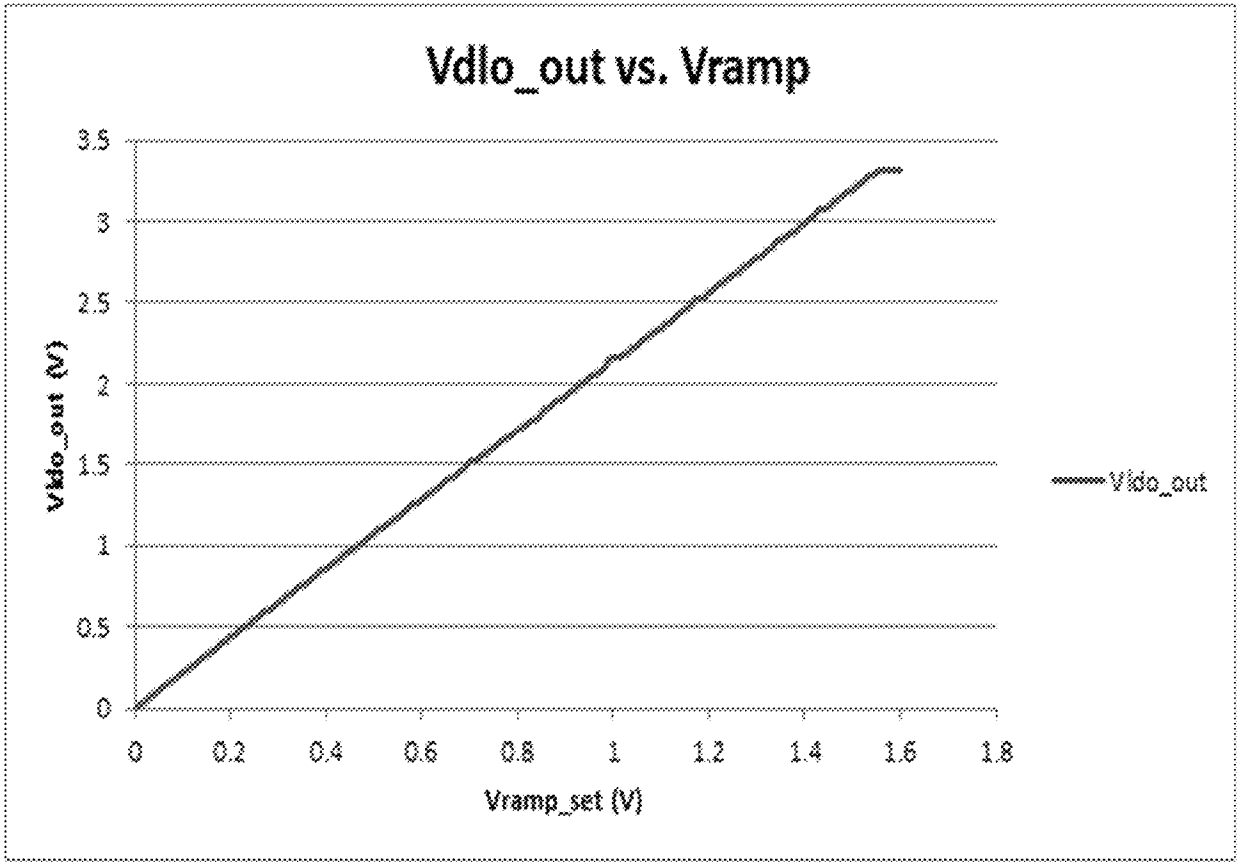
FIG. 3 shows a graph representing an output voltage response with respect to the Vramp voltage of the prior art configuration of FIG. 2.

FIG. 3 shows a graph representing the LDO_out voltage response with respect to the Vramp voltage of the prior art configuration of FIG. 2. As can be seen in FIG. 3, the LDO_out voltage tracks the Vramp voltage in a range of [0 V, 1.6 V], corresponding to a regulated operation of the LDO regulator (110), after which the LDO_out voltage saturates (rails) and remains at a substantially constant high level of approximately 3.25 volts, corresponding to an unregulated operation of the LDO regulator (110).

Figure 4:
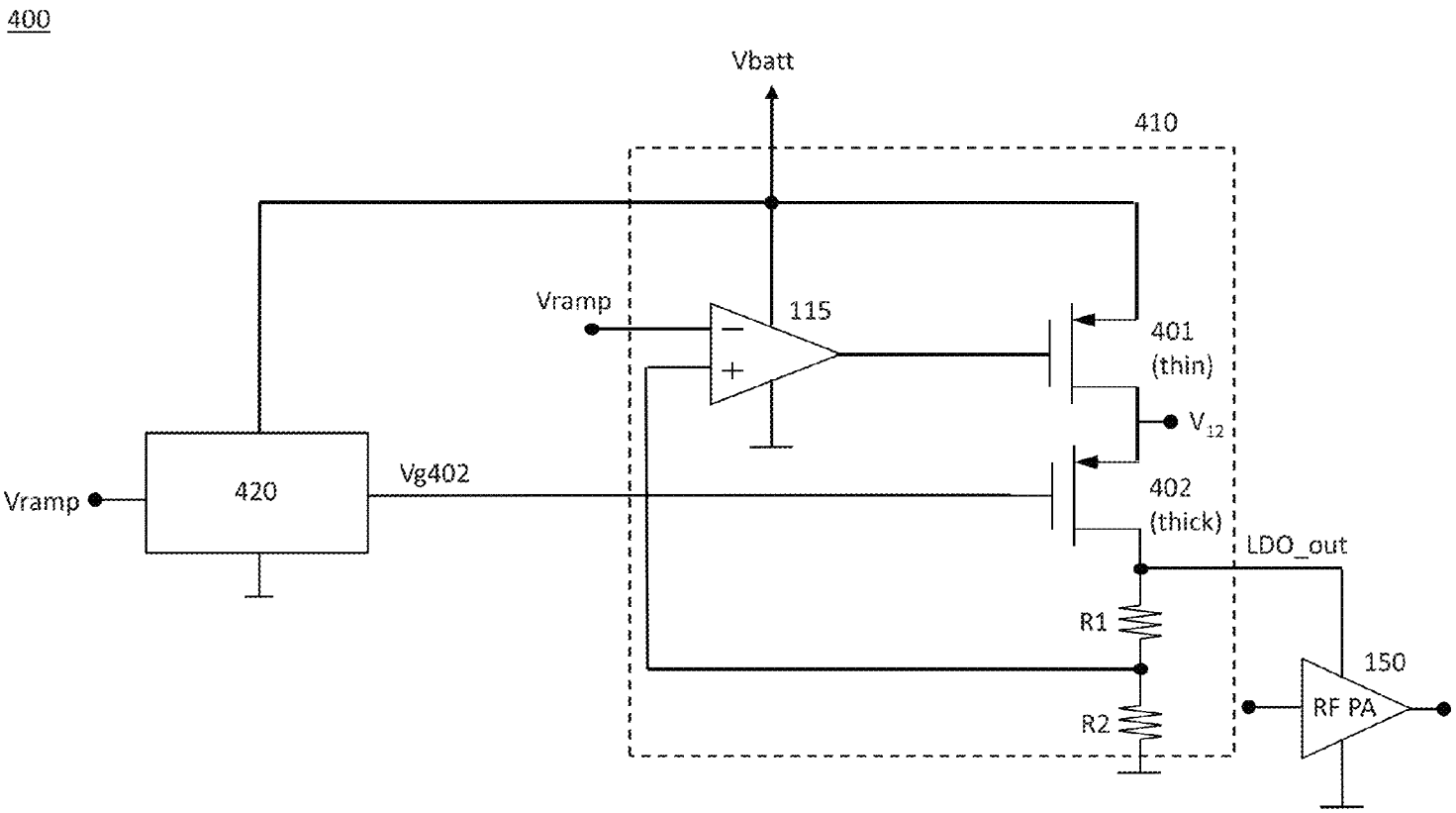
FIG. 4 is a simplified schematic representation of the LDO regulator according to an embodiment of the present disclosure wherein a combination of thick and thin pass devices is used to allow regulation for higher load currents (or over an extended Vramp voltage range) when compared to an LDO configuration with thick pass devices and a same total physical layout area. A variable biasing circuit modifies biasing to the lower pass device based on levels of the supply voltage, Vbatt, and the Vramp voltage.

FIG. 4 shows a configuration (400) according to an embodiment of the present disclosure that addresses the above mentioned two operating critical conditions of an LDO regulator (410) differently from the prior art configurations depicted in FIG. 1 and FIG. 2, by the provision of at least one thin pass device (e.g. 401), and a variable biasing circuit (420) that provides a variable bias voltage, Vg402, that is based on a combination of the supply voltage Vbatt and the Vramp voltage, to the gate of the cascode pass device (402), to further protect the thin pass device (401) from being subjected to a higher voltage than its voltage withstand capability. According to an exemplary embodiment of the present disclosure, the thin pass device (e.g. 401) may have a shorter gate length (Lg) than the pass device (101) of the prior art configurations of FIG. 1 and FIG. 2, which can in turn allow for a lower drain-to-source saturation voltage, Vdsat, of the thin pass device (401). The shorter gate length can in turn allow for a reduced gate-to-source voltage, Vgs, of the thin pass device (401) while operating in its saturation region of operation.

Provision of a thin pass device (401), according to the embodiment of the present disclosure depicted in FIG. 4, can allow for a lower drain-to-source saturation voltage (Vdsat) of the thin pass device (401), as compared to a Vdsat of the thick device (101) of the prior art configurations of FIG. 1 and FIG. 2, and therefore, when in the second critical operating condition, operation of the thin pass device (401), in its saturation region of operation, can be maintained. In turn, such lower Vdsat of the thin pass device (401) can allow for a larger gate-to-source voltage (Vgs) across the gate and source of the thick pass device (402) of the configuration (400) according to the present embodiment, as the lower Vdsat can allow for a higher voltage at the common drain-source node V12 of the two pass devices. A larger Vgs applied to the thick pass device (402) can allow for lowering of the $R_{ON}$ of the thick pass device (402) when operating in its triode region of operation. Therefore, the configuration (400) according to the present disclosure depicted in FIG. 4, can allow maintaining operation of the thin pass device (401) in its saturation region of operation while lowering the $R_{ON}$ of the thick pass device (402) when operating in its triode region of operation when the LDO regulator (410) operates according to the second critical operating condition. Finally, maintaining the thin pass device (401) in its saturation region of operation can allow for a large enough gain of the LDO regulator (410) to maintain regulation of the LDO_out voltage when the LDO regulator (410) operates according to the second critical operating condition.

A person skilled in the art would know that the thin pass device (401) of FIG. 4 may provide a higher transconductance ($g_m$) and a lower $R_{ON}$ than the thick pass device (101) of FIG. 1 and FIG. 2. However, the thin pass device (401) may provide a lower breakdown voltage than the thick pass device (101). Various embodiments according to the present disclosure may advantageously use benefits of the thin pass device (401) in the LDO regulator configuration of FIG. 4 based on design goals and parameters. According to one such exemplary embodiment of the present disclosure, a width (e.g. size) of the thin pass device (401) can be same as a width of the thick pass device (402), such as to provide for a relatively higher gate capacitance (e.g. Cgs, Cgd) and a substantially lower resistance $R_{ON}$ of the thin device (401). According to an alternative embodiment of the present disclosure, the width of the thin pass device (401) may be adjusted (reduced) to provide a substantially same gate capacitance as the thick pass device (101) while providing an acceptable low resistance $R_{ON}$. According to yet another alternative embodiment of the present disclosure, the width of the thin pass device (401) may be adjusted to provide a substantially same resistance $R_{ON}$ while providing a lower gate capacitance. Design goals and parameters may drive the choice of a configuration based on possible tradeoffs. For example, the gate capacitance can affect the LDO bandwidth (and bias current), a lower device resistance $R_{ON}$ can result in a lower Vdsat or lower drain-source voltage headroom requirements, and the transconductance ($g_m$) may affect the loop gain and bandwidth. Similarly, the gate length (Lg) of the thin pass device (401) may also be designed according to design goals and parameters which consequently define possible implementation tradeoffs With further reference to the LDO configuration (400) of FIG. 4, a corresponding design goal may be the ability to keep the top pass device (401) in saturation when the pass devices (401, 402) are subjected to the lower voltage drop, per the second critical operating case, which can therefore provide for a higher loop gain and therefore maintain regulation of the LDO_out voltage. The lower Vdsat of the top (thin) device (401) can allow the top device to remain in saturation and therefore provide the higher loop gain in spite of the lower voltage drop across the pass devices (401, 402). Alternatively, one may keep both devices (401, 402) as thick devices, but making such devices wider to reduce their resistance $R_{ON}$, at the cost of an increase in a layout area of the configuration (400) and an increase in gate capacitance of the pass devices. The use of the thin device (401) according to the embodiment of the present disclosure results in a better optimization of pass devices performance.

With further reference to the configuration (400) according to the present disclosure depicted in FIG. 4, when in the first critical operating condition, the variable biasing circuit (420) can bias the thick pass device (402) so as to provide a division of the high voltage across the pass devices (401, 402) according to their respective withstand voltages (the thin pass device may have a lower withstand voltage due to its inherently lower breakdown voltage), and when in the second critical operating condition, the variable biasing circuit (420) biases the thick pass device (402) so as to skew the division of a voltage across the two pass devices towards a larger share of such voltage across the thick pass device (402). A person skilled in the art would understand that by varying the voltage Vg402 to the gate of the thick pass device (402), a voltage at the common drain-source node, Vu, of the two pass devices (401, 402) is varied to provide a desired division of the voltage across the two pass devices. By providing the supply voltage, Vbatt, and the Vramp voltage to the variable biasing circuit (420), operation according to the two critical operating conditions can be determined and corresponding biasing voltage Vg402 generated. A person skilled in the art would know of many possible implementations of the variable biasing circuit (420) for implementing the configuration (400) according to the present teachings.

Figure 5:
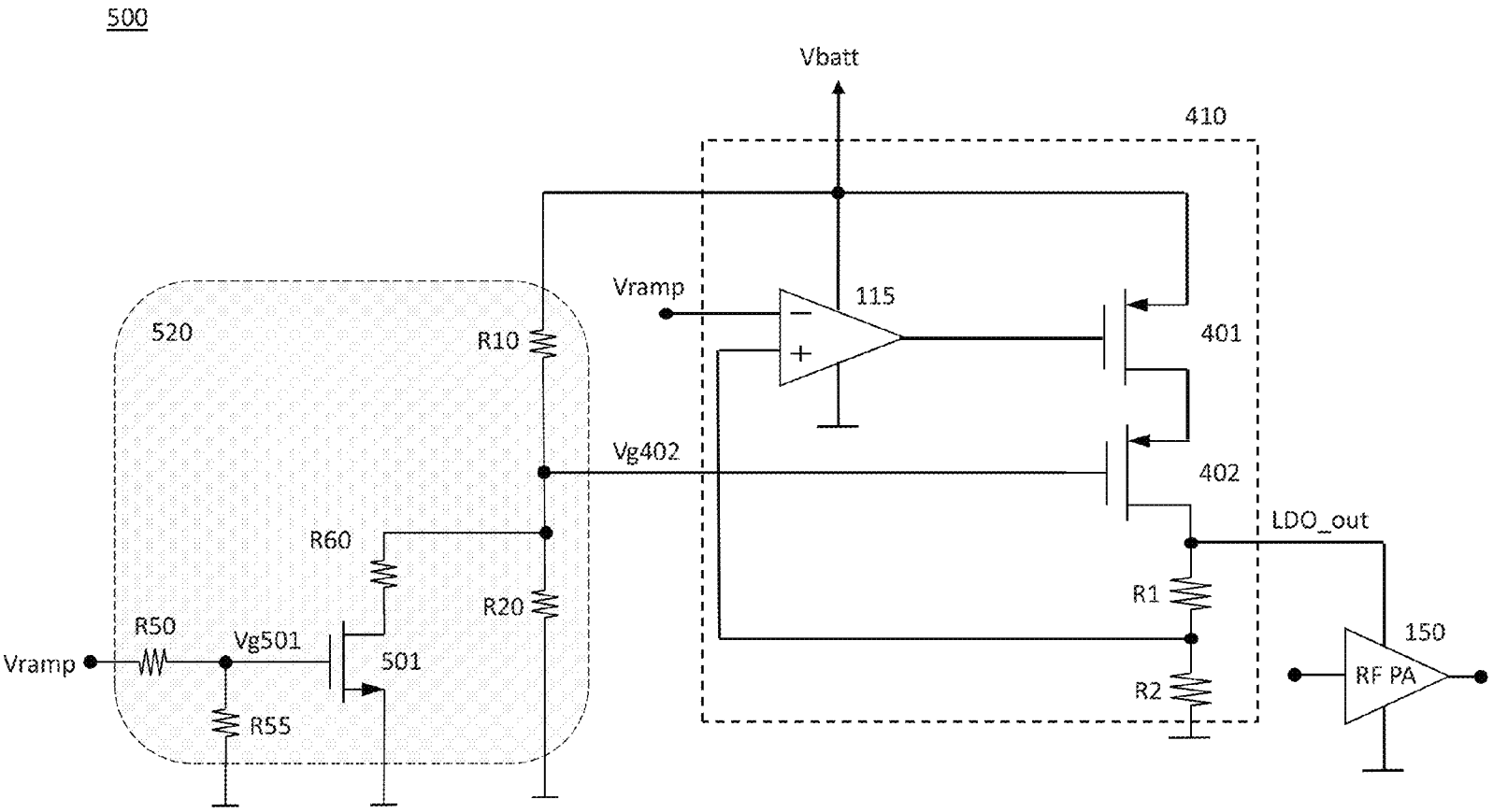
FIG. 5 shows an exemplary embodiment according to the present disclosure of the variable biasing circuit of FIG. 4 wherein biasing to the lower pass device is modified via a configurable resistive voltage divider.

FIG. 5 shows an exemplary non-limiting variable biasing circuit (520) which can be used as the variable biasing circuit (420) of the configuration according to the present disclosure depicted in FIG. 4. An NMOS transistor (501), operating as a variable resistor controlled by the Vramp voltage and the supply voltage, Vbatt, is used to provide a variable (voltage) gain of the variable biasing circuit (520) as operation of the LDO circuit transitions from the first critical operating condition to the second critical operating condition, and vice versa. Such variable gain varies the voltage Vg402 provided at a common node of a resistor tree (R10, R20) as a function of the Vramp voltage and of the supply voltage Vbatt. As the variable resistor provided by the transistor (501) is varied via varying of the Vramp voltage, an equivalent resistor that is in parallel with the resistor R20 of the resistor tree (R10, R20) is also varied, therefore varying a voltage gain Vg402/Vbatt. A person skilled in the art would realize that the combination of fixed resistors (R50, R55, R60) and the variable resistor of the transistor (501) provide said equivalent resistor. As the resistance of the transistor (501) increases as a function of Vramp increasing, the voltage gain Vg402/Vbatt of the variable biasing circuit (520) decreases as a function of Vramp increasing, and therefore a higher gain is provided when the LDO circuit operates close to the first critical operating condition than provided when it operates close to the second critical operating condition. According to an exemplary embodiment of the present disclosure, the equivalent resistor may be designed to continuously vary as a function of the Vramp and supply voltage, and therefore continuously vary the voltage gain Vg402/Vbatt. Alternative embodiments according to the present disclosure of the voltage gain Vg402/Vbatt are within reach of a person skilled in the art, including, using discrete variation of such voltage gain where gain changes are performed at discrete voltage points of Vramp and/or Vbatt, or using piece wise continuous gain variation, where the voltage gain is continuously varied between voltage points of Vramp and/or Vbatt and held constant between such voltage points.

With continued reference to FIG. 5, according to another exemplary embodiment of the present disclosure, a resistance of the transistor (501) may vary from a value substantially lower than a resistance of R60 to a value substantially higher than the resistance of R60 as the LDO circuit transitions from the first critical operating condition to the second critical operating condition. Accordingly, the gain of the variable biasing circuit (520) may be bounded by a high gain, determined by the resistor tree (R10, R20) when operating close to the first critical condition, and a low gain, determined by the resistor tree (R10, R20//R60) when operating close to the second critical condition. It should be noted that although operation of the transistor (501) has been described as a variable resistor, alternative embodiments according to the present disclosure where the transistor (501) operates essentially as a switch are also possible. In such alternative embodiments, the switch can provide a discrete gain change at a discrete point (e.g. with respect to Vramp and/or Vbatt) of operation between the first and the second critical operating conditions. More than one transistor (501) may be provided to provide more than one discrete gain change points. Finally, a combination of discrete gain change points and continuous variable gain segments may also be envisioned.

With further reference to FIG. 5, when operating at or close to the first critical condition, through its higher gain, the variable biasing circuit (520) generates Vg402 that biases the pass device (402) so as to provide a desired division of the high voltage across the two pass devices (401, 402) while limiting voltages across each of the pass devices within their voltage withstand capabilities. When operating at or close to the second critical condition, through its lower gain, the variable biasing circuit (520) generates a smaller Vg402 that allows for a larger gate-to-source voltage (Vgs) across the gate and source of the thick pass device (402), and therefore allows for a lower $R_{ON}$ of the thick pass device (402), while the thin pass device (401) operates in its saturation region with a transconductance ($g_m$) high enough to allow regulation of the LDO_out voltage. As design goals may vary, it is conceivable that when operating at or close to the second critical condition, the lower gain of the variable biasing circuit (520) may be designed to generate a Vg402 voltage level that allows for a higher drain-to-source voltage (Vds) of the thin pass device (401) to maintain operation of such device in its saturation region longer (e.g. for higher values of the supply voltage and/or higher current loads).

Figure 6B:
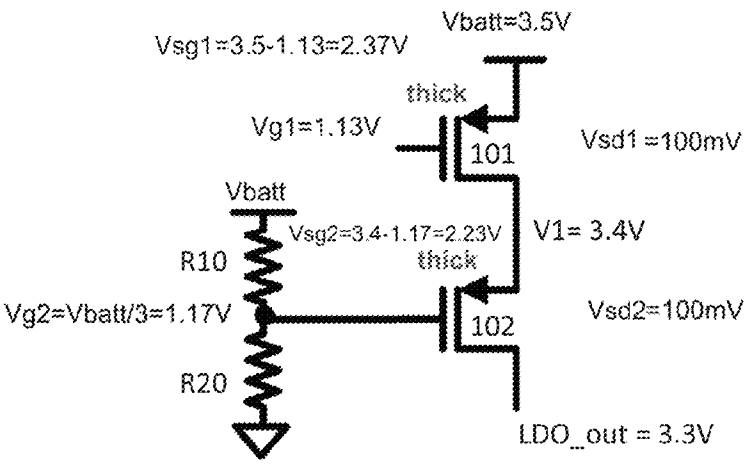
FIGS. 6A, 6B, 6C and 6D show voltages at various nodes of the pass devices of the configurations of FIG. 2 and FIG. 5 for a case wherein a voltage across the pass devices is at a higher level, and a case wherein such voltage is at a lower level.
Figure 6A:
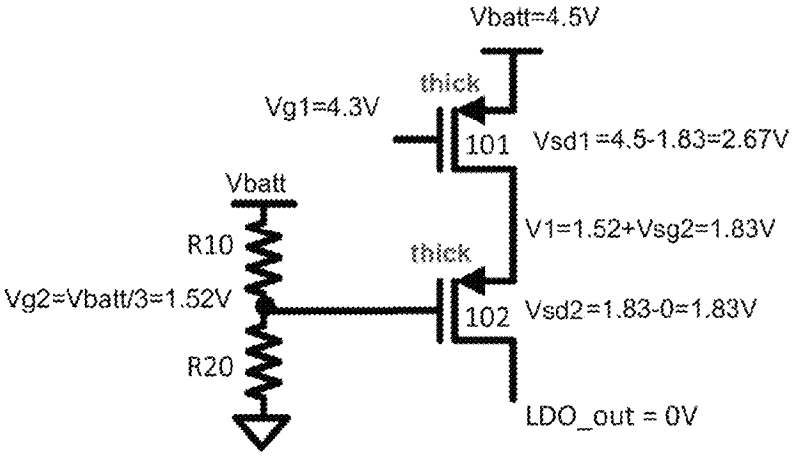
Figure 6D:
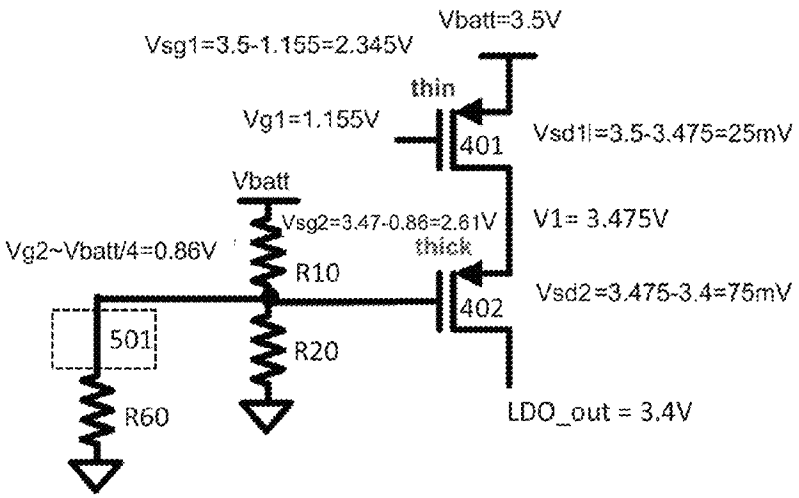
Figure 6C:
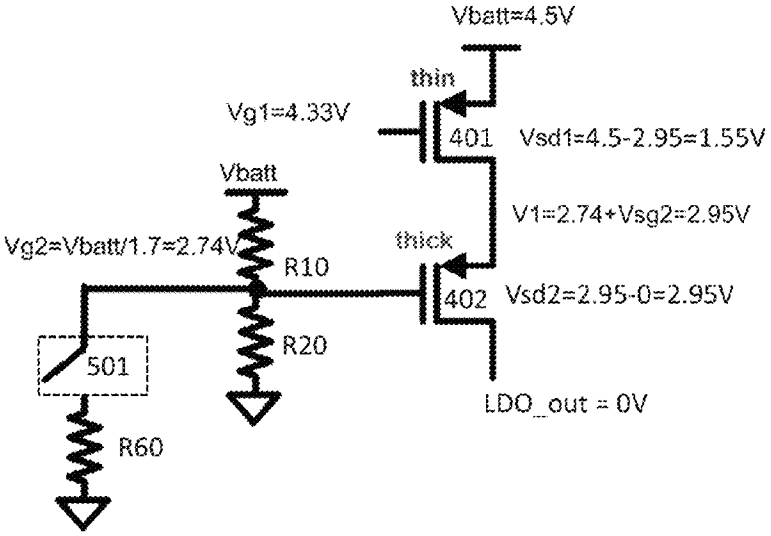

FIG. 6A shows exemplary voltages at various nodes of the pass devices (101, 102) of the prior art configuration of FIG. 2 when operating according to the first critical condition. As can be seen in FIG. 6A, the resistor divider divides the supply voltage, Vbatt, by three, and provides a gate voltage, denoted Vg2, to the gate of the thick pass device (102). Accordingly, the common source-drain node of the two pass devices (101, 102) carries a voltage, denoted V1, that is the sum of Vg2 and the source-to-gate voltage, Vgs2, of the thick pass device (102). A voltage division of the voltage across the two pass devices (=4.5 volts) is divided across the pass devices so as to provide a source-to-drain voltage, Vsd1, of the thick pass device (101), and a source-to-drain voltage, Vsd2, of the thick pass device (102), where Vsd1 and Vsd2 are within a voltage withstand capability of the respective pass devices (101) and (102). FIG. 6C shows exemplary voltages at the same nodes of the pass devices (401, 402) of the configuration according to the present disclosure depicted in FIG. 5 when operating in the first critical condition and assuming that the resistance of the variable resistor provided by the transistor (501) is very large (therefore approximates to an open circuit). Because the pass device (401) is a thin device with a reduced breakdown voltage (and therefore reduced voltage withstand), the voltage divider (R10, R20) provides a higher gate voltage Vg2 (e.g. 2.74 volts) as compared to the Vg2 of the prior art configuration shown in FIG. 6A. Such larger Vg2 allows for a higher voltage V1 (e.g. 2.95 volts) at the common source-drain node of the pass devices (401, 402) for a lower share (e.g. Vsd1=1.55 volts, Vsd2=2.95 volts) of the total voltage (e.g. 4.5 volts) across the pass devices (401, 402) provided across the thin device (401).

FIG. 6B shows exemplary voltages at various nodes of the pass devices (101, 102) of the prior art configuration of FIG. 2 when operating according to the second critical condition. As can be seen in FIG. 6B, the resistor divider divides the supply voltage, Vbatt, by three, and provides a gate voltage, denoted Vg2, to the gate of the thick pass device (102) equal to 1.17 volts. As the total voltage across the two pass devices (101, 102) is a low voltage, substantially lower than the voltage withstand of the pass devices, division of the total voltage across each of the pass devices is not as critical as during operation in the first critical condition. As the ramp voltage, Vramp, increases to its maximum value, to provide a maximum LDO_out voltage, the pass devices are pushed to operate with smaller source-to-drain voltages to minimize a voltage drop (Vsd1+Vsd2) across the two pass devices (101, 102). In turn, this pushes the pass devices (101, 102) to operate in their respective triode regions of operation where a combination of their $R_{ON}$ resistance and a current through the pass devices (101, 102) limit the available voltage at LDO_out to an effective value lower than a maximum expected value. In this case, the LDO regulator has stopped regulating the LDO_out voltage. The effective value of the LDO_out voltage is 3.3 volts due to a voltage drop of 100+100=200 mV across the pass devices (101, 102). In contrast, as can be seen in FIG. 6D, which shows exemplary voltages at the same nodes of the pass devices (401, 402) of the configuration according to the present disclosure depicted in FIG. 5 when operating in the first critical condition and assuming that the resistance of the variable resistor provided by the transistor (501) is very small (therefore approximates to an open circuit), the effective LDO_out voltage is 3.4 volts, which is the expected voltage per design of the LDO regulator. As described above, regulation of the LDO_out voltage during operation in the second critical condition is made possible by the thin passive device (401) which maintains operation in its saturation region of operation in spite of a lower source-to-drain voltage, Vsd1, while allowing for a larger Vsg2 of the thick pass device (402) for a lower $R_{ON}$ of the thick pass device. The larger Vsg2 is provided by lowering the gate voltage Vg2 of the thick pass device, via insertion of the resistor R60 in the voltage divider (R10, R20), and therefore operating the thick pass device (402) with a larger value of Vsg2 for a lower $R_{ON}$.

Figure 7A:
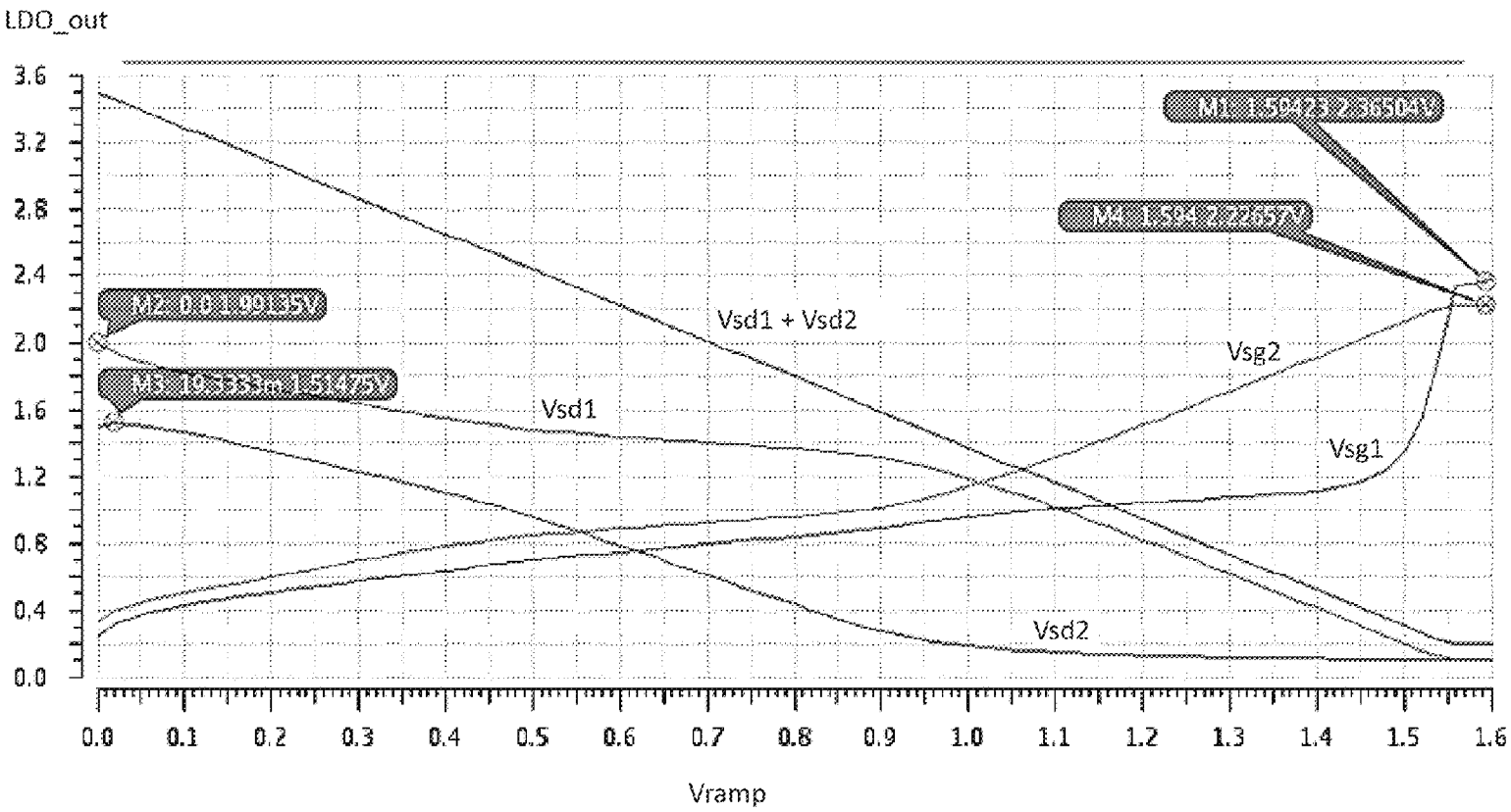
FIGS. 7A and 7B show voltages at various nodes of the pass devices of the configurations of FIG. 2 and FIG. 5 as functions of the ramp voltage Vramp.
Figure 7B:
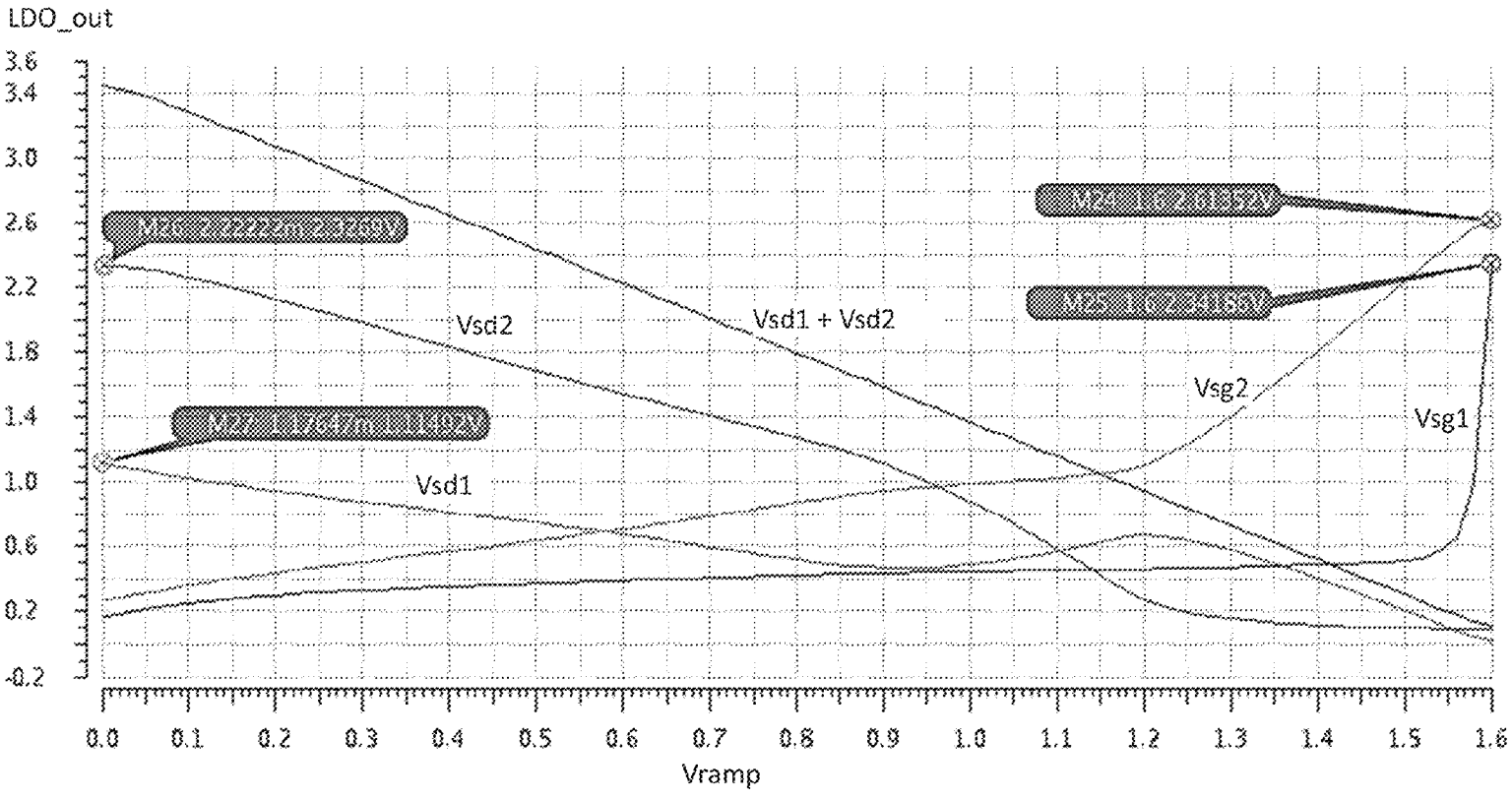
Figure 7C:
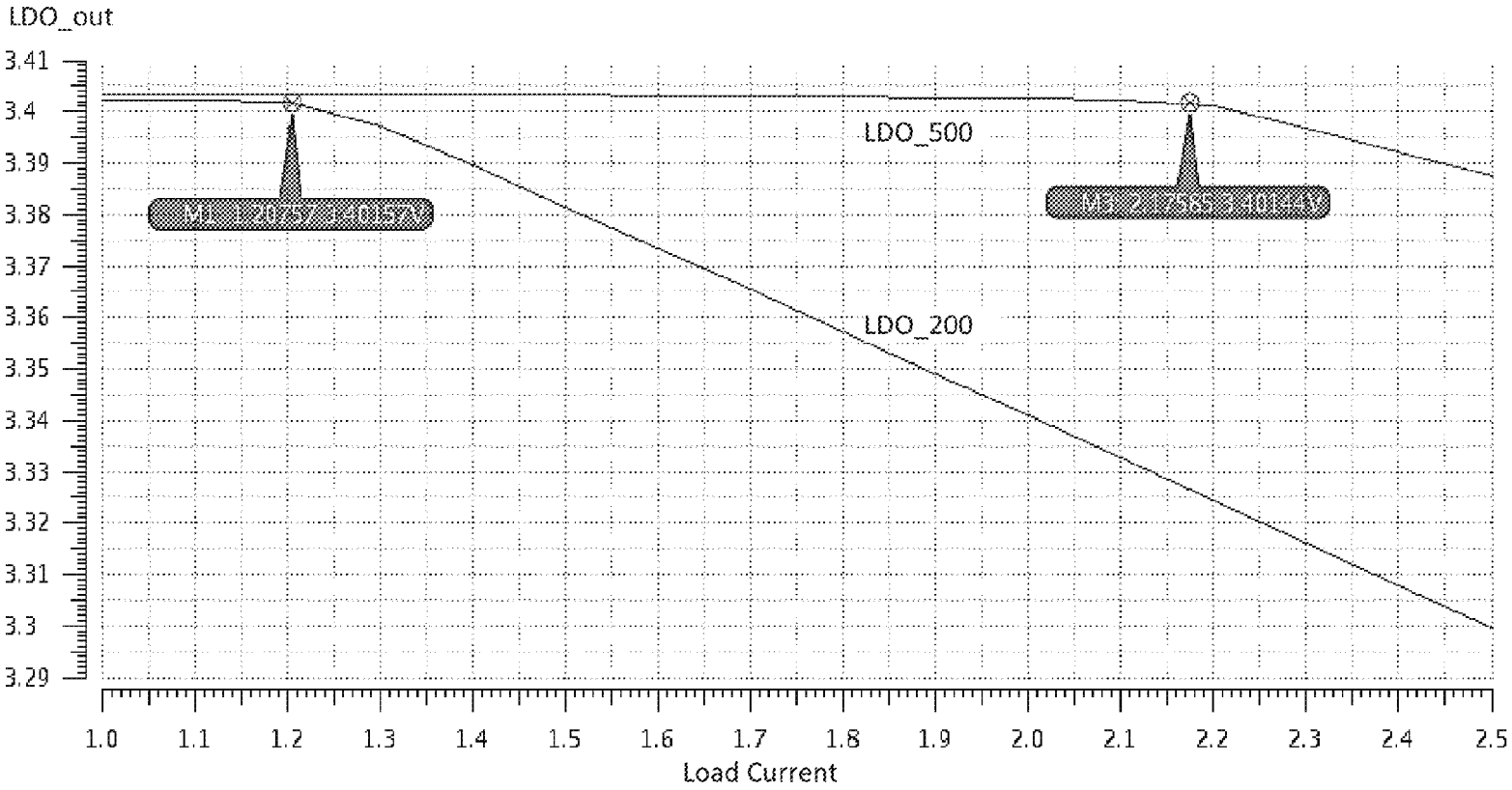
FIG. 7C shows impact of increasing load currents though the pass devices of the configurations of FIG. 2 and FIG. 5 on regulation of a corresponding LDO regulator.

FIG. 7A and FIG. 7B respectively show voltages at the various nodes of the pass devices (101, 102) of the prior art configuration of FIG. 2 and voltages at the various nodes of the pass devices (401, 402) of the configuration according to the present disclosure depicted in FIG. 5, as functions of the ramp voltage, Vramp. It should be noted that the main differences in the two configurations is the usage, per FIG. 5, of the thin pass device (401) and the of the variable biasing circuit (520) as opposed to the usage, per FIG. 2, of thick pass device (101) and the fixed biasing circuit (205), while maintaining a same physical circuit layout area by virtue of maintaining same total widths of the pass devices (401, 402) and (101, 102). Similar annotation of node voltages as per FIGS. 6A-6D is used in FIG. 7A and FIG. 7B. As can be seen in FIG. 7A, as the ramp voltage increases, the total voltage drop Vsd1+Vsd2 across the two pass devices (101, 102) stops decreasing (flattens) at a Vramp voltage approximately equal to 1.55 volts, at which point the Vsg1 voltage also saturates. In other words, at such point, the prior art operational amplifier (115) is railed and cannot further affect the Vsg1 voltage of the thick pass device (101). In contrast, as can be seen in FIG. 7B, throughout the voltage range of Vramp, the total voltage drop Vsd1+Vsd2 across the two pass devices (401, 402) of the configuration according to the present teachings continues to change as to provide a regulated output voltage (LDO_out=Vbatt−(Vsd1+Vsd2)). FIG. 7C contrasts a high load current capability of the two configurations while operating in regulation. As can be seen in the graph labelled LDO_200 of FIG. 7C, the prior art configuration of FIG. 2 provides a high (maximum) load current of approximately 1.2 amps while regulating the output voltage at 3.4 volts, after which the regulator stops regulating, and therefore output voltage decreases as the load current increases beyond 1.2 amps. In contrast, as can be seen in the graph labelled LDO_500 of FIG. 7C, the embodiment according to the present disclosure, as depicted in FIG. 5, can provide a high load current of approximately 2.0 amps while maintaining output voltage regulation. A person skilled in the art would appreciate the larger output voltage regulation range and the higher load current while in regulation provided by the embodiment according to the present teachings while maintaining a same physical circuit layout area.

Figure 8:
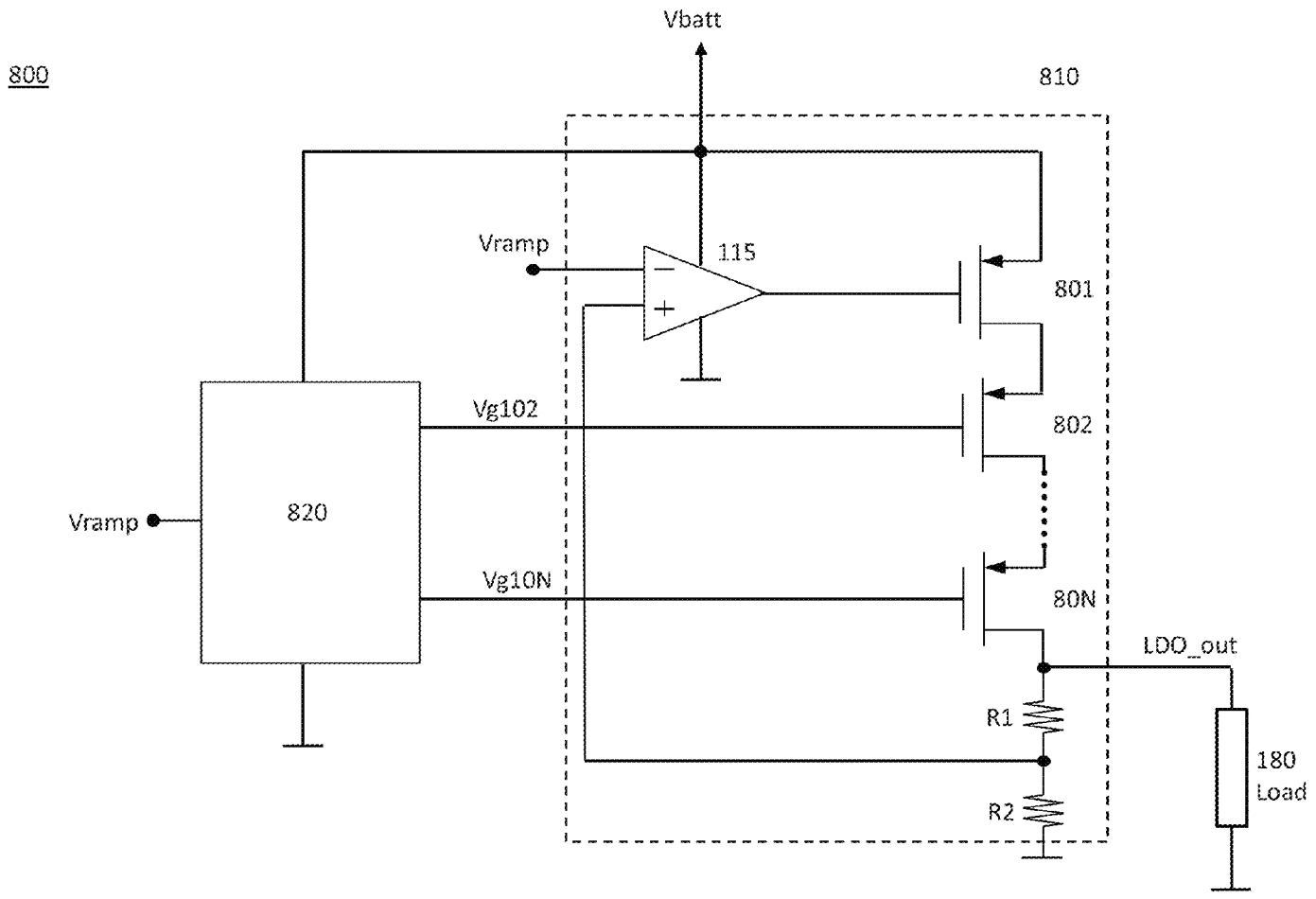
FIG. 8 is a simplified schematic representation of the LDO regulator according to an embodiment of the present disclosure wherein a combination of a plurality, N, thick and thin pass devices is used to allow regulation over an extended Vramp voltage range. A variable biasing circuit modifies biasing to the lower pass device based on levels of the supply voltage, Vbatt, and the Vramp voltage. Principle of operation of such LDO regulator is similar to one described in reference to FIGS. 4 and 5.

A person skilled in the art would understand that the teachings according to the present disclosure may equally apply to LDO regulator configurations with increased number of pass devices, as shown in FIG. 8. The LDO regulator configuration (800) according to an embodiment of the present disclosure depicted in FIG. 8 comprises a plurality, N, pass devices (801, 802, . . . , 80N), where the top pass device (401) is controlled by the operational amplifier (115), and other pass devices (802, . . . , 80N) are in turn controlled by a combination of the top pass device (801) and a variable biasing circuit (820) that provides variable bias voltages, Vg802, . . . , Vg80N that are based on a combination of the supply voltage Vbatt and the Vramp voltage, to the gates of the cascode pass devices (802, . . . , 80N). Operation of the LDO regulator configuration (800) of FIG. 8 is similar to operation of the configurations (400, 500) depicted in FIG. 4 and FIG. 5 described above. The larger number of pass devices can allow for a larger supply voltage Vbatt, or can allow for a larger number of thin pass devices. It is within the capability of a person skilled in the art to apply the teachings according to the present disclosure described above with reference to FIG. 4 and FIG. 5, to the configuration depicted in FIG. 8. The person skilled in the art would realize that one or more of the pass devices (801, 802, . . . , 80N) may be thin devices while the remaining pass devices may be thick pass devices. The variable biasing circuit (820) may be used to control voltages across the pass devices (801, 802, . . . , 80N) during the first critical operating condition to be within respective voltage withstand capabilities of the pass devices. During operation in the second critical condition, the variable biasing circuit can lower gate voltages of the thick pass devices to allow corresponding increased gate-to-source voltages for lower $R_{ON}$ of such thick pass devices, while allowing operation of the thin pass devices in their respective saturation regions of operation, and therefore allowing operation of the regulator in a closed loop.

The teachings according to the present disclosure allow for a combination of thin and thick pass devices in an LDO regulator that in combination allow regulation of the output voltage (LDO_out) over a wider range of input control voltage (Vramp). According to one exemplary embodiment of the present disclosure, the pass devices are merged devices, such as to share a common drain-source region, as described, for example, in the above referenced U.S. Pat. No. 8,987,792 B2, whose disclosure is incorporated herein by reference in its entirety. Such merging of the pass devices can allow for a reduced circuit layout of the LDO regulator according to the present teachings when monolithically integrated.

Figure 9:
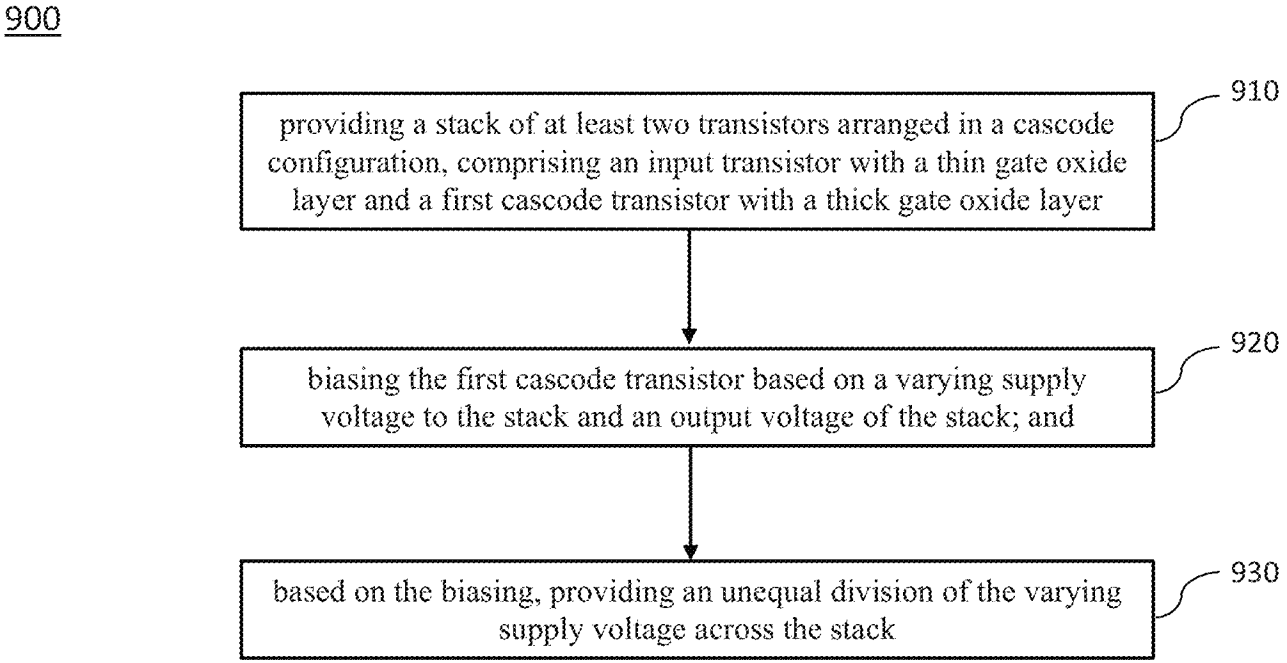
FIG. 9 is a process chart (900) showing various steps of a method for adjusting a bias voltage of a cascode transistor according to an embodiment of the present disclosure.

FIG. 9 is a process chart (900) showing various steps of a method adjusting a bias voltage of a cascode transistor according to an embodiment of the present disclosure. As can be seen in the process chart (900), the method comprises: providing a stack of at least two transistors arranged in a cascode configuration, comprising an input transistor with a thin gate oxide layer and a first cascode transistor with a thick gate oxide layer, per step 910; biasing the first cascode transistor based on a varying supply voltage to the stack and an output voltage of the stack, per step 920; and based on the biasing, providing an unequal division of the varying supply voltage across the stack, per step 930.

As should be readily apparent to one of ordinary skill in the art, various embodiments of the invention can be implemented to meet a wide variety of specifications. Unless otherwise noted above, selection of suitable component values is a matter of design choice and various embodiments of the invention may be implemented in any suitable IC technology (including but not limited to MOSFET structures), or in hybrid or discrete circuit forms. Integrated circuit embodiments may be fabricated using any suitable substrates and processes, including but not limited to standard bulk silicon, silicon-on-insulator (SOI), and silicon-on-sapphire (SOS). Unless otherwise noted above, the invention may be implemented in other transistor technologies such as bipolar, GaAs HBT, GaN HEMT, GaAs pHEMT, and MESFET technologies. However, the inventive concepts described above are particularly useful with an SOI-based fabrication process (including SOS), and with fabrication processes having similar characteristics. Fabrication in CMOS on SOI or SOS enables low power consumption, the ability to withstand high power signals during operation due to FET stacking, good linearity, and high frequency operation (in excess of about 10 GHz, and particularly above about 20 GHz).

Voltage levels may be adjusted or voltage and/or logic signal polarities reversed depending on a particular specification and/or implementing technology (e.g., NMOS, PMOS, or CMOS, and enhancement mode or depletion mode transistor devices). Component voltage, current, and power handling capabilities may be adapted as needed, for example, by adjusting device sizes, serially "stacking" components (particularly FETs) to withstand greater voltages, and/or using multiple components in parallel to handle greater currents. Additional circuit components may be added to enhance the capabilities of the disclosed circuits and/or to provide additional functional without significantly altering the functionality of the disclosed circuits.

A number of embodiments of the invention have been described. It is to be understood that various modifications may be made without departing from the spirit and scope of the invention. For example, some of the steps described above may be order independent, and thus can be performed in an order different from that described. Further, some of the steps described above may be optional. Various activities described with respect to the methods identified above can be executed in repetitive, serial, or parallel fashion.

It is to be understood that the foregoing description is intended to illustrate and not to limit the scope of the invention, which is defined by the scope of the following claims, and that other embodiments are within the scope of the claims. (Note that the parenthetical labels for claim elements are for ease of referring to such elements, and do not in themselves indicate a particular required ordering or enumeration of elements; further, such labels may be reused in dependent claims as references to additional elements without being regarded as starting a conflicting labeling sequence).

The invention claimed is:

1. A circuit arrangement comprising:

a stack of at least two transistors arranged in a cascode configuration, comprising an input transistor and a first cascode transistor; and a biasing circuit configured to provide a first bias voltage to the first cascode transistor, wherein:

a supply voltage to the stack is a varying supply voltage, the first bias voltage is a function of the varying supply voltage and an output voltage at an output of the stack, the varying supply voltage varies between a low supply voltage and a high supply voltage, the output voltage is bound by a low output voltage and a high output voltage, and a voltage gain of the biasing circuit is configured to change according to at least two conditions:

i) a first condition wherein the varying supply voltage is at the high supply voltage and the output voltage is at the low output voltage, and ii) a second condition wherein the varying supply voltage is at the low supply voltage and the output voltage is at the high output voltage, wherein the voltage gain of the biasing circuit during operation according to the first condition is higher than the voltage gain of the biasing circuit during operation according to the second condition, the voltage gain being defined as a ratio of the first bias voltage and the varying supply voltage.

2. The circuit arrangement according to claim 1, wherein:

the input transistor has a shorter gate length than the first cascode transistor, and/or the input transistor has a thin gate oxide layer and the first cascode transistor has a thick gate oxide layer.

3. The circuit arrangement according to claim 2, wherein a thickness of the gate oxide layer of the input transistor is 30 Angstroms or less, and a thickness of the gate oxide layer of the first cascode transistor is 70 Angstroms or more.

4. The circuit arrangement according to claim 2, wherein a ratio between a thickness of the gate oxide layer of the input transistor and a thickness of the gate oxide layer of the first cascode transistor is 0.5 or less.

5. The circuit arrangement according to claim 2, wherein a gate length of the input transistor is 0.13 μm or shorter, and a gate length of the first cascode transistor is 0.30 μm or longer.

6. The circuit arrangement according to claim 2, wherein a ratio of a gate length of the input transistor and a gate length of the first cascode transistor is 0.5 or less.

7. The circuit arrangement according to claim 1, wherein the voltage gain continuously varies between a higher voltage gain during operation according to the first condition and a lower voltage gain during operation according to the second condition.

8. The circuit arrangement according to claim 1, wherein the voltage gain discretely varies between a higher voltage gain during operation according to the first condition and a lower voltage gain during operation according to the second condition.

9. The circuit arrangement according to claim 1, wherein the voltage gain varies between a higher voltage gain during operation according to the first condition and a lower voltage gain during operation according to the second condition in one or more of: a) continuously in segments, and b) in discrete steps.

10. The circuit arrangement according to claim 1, wherein:

a voltage difference between the output voltage and the varying supply voltage define a voltage across the stack;

during operation according to the first condition, the first bias voltage is adapted to provide an unequal voltage division of the voltage across the stack over each of the at least two transistors, and during operation according to the second condition, the first bias voltage is adapted to skew the unequal voltage division with a larger share of the voltage across the stack over the first cascode transistor.

11. The circuit arrangement according to claim 10, wherein the first bias voltage is adapted to maintain operation of the input transistor in a saturation region during operation according to the first condition and the second condition.

12. The circuit arrangement according to claim 10, wherein the first bias voltage is adapted to provide a larger gate to source voltage to the first cascode transistor during operation according to the second condition.

13. The circuit arrangement according to claim 12, wherein during operation according to the second condition:

the first cascode transistor operates in a triode region, and the larger gate to source voltage is adapted to provide a lower drain-to-source resistance of the first cascode transistor.

14. The circuit arrangement according to claim 1, wherein the biasing circuit comprises:

a configurable resistive divider coupled between the varying supply voltage and a reference potential, wherein a first node of the configurable resistive divider carries the first biasing voltage.

15. The circuit arrangement according to claim 14, wherein the biasing circuit further comprises:

a resistor comprising a first terminal coupled to the first node and a second terminal;

a transistor adapted to couple the second terminal of the resistor to the reference potential based on operation according to one of the first condition and second condition.

16. The circuit arrangement according to claim 15, wherein the transistor is configured to operate as a voltage controlled variable resistor.

17. The circuit arrangement according to claim 15, wherein the transistor is configured to operate as a switch.

18. The circuit arrangement according to claim 1, wherein:

the stack is a pass device of a low dropout regulator (LDO) that provides a conduction path between a source of the input transistor of the stack connected to the varying supply voltage, and a drain of a last cascode transistor of the at least two transistors of the stack carrying the output voltage, said drain connected to a load, responsive to a control voltage provided to the input transistor, the output voltage varies, and responsive to the control voltage and the varying supply voltage the biasing circuit operates according to the at least two conditions, wherein:

during operation according to the first condition, the at least two transistors of the stack operate in their respective saturation regions of operation, during operation according to the second condition, the input transistor maintains operation in its respective saturation region of operation, and during operation according to the second condition, the first cascode transistor operates in a respective triode region of operation, and the biasing circuit is adapted to reduce the first bias voltage to increase a gate-to-source voltage of the first cascode transistor for a reduction in a corresponding drain-to-source resistance.

19. A method for adjusting a bias voltage of a cascode transistor, the method comprising:

providing a stack of at least two transistors arranged in a cascode configuration, comprising an input transistor and the cascode transistor;

biasing, by a biasing circuit, the cascode transistor based on a varying supply voltage to the stack and an output voltage of the stack; and based on the biasing, providing an unequal division of the varying supply voltage across the stack, wherein:

the varying supply voltage varies between a low supply voltage and a high supply voltage, the output voltage is bound by a low output voltage and a high output voltage, and a voltage gain of the biasing circuit is configured to change according to at least two conditions:

i) a first condition wherein the varying supply voltage is at the high supply voltage and the output voltage is at the low output voltage, and ii) a second condition wherein the varying supply voltage is at the low supply voltage and the output voltage is at the high output voltage, wherein the voltage gain of the biasing circuit during operation according to the first condition is higher than the voltage gain of the biasing circuit during operation according to the second condition, the voltage gain being defined as a ratio of the bias voltage and the varying supply voltage.

20. The method according to claim 19, wherein the providing of the unequal division further comprises:

providing a first unequal division when the output voltage is at a lower voltage level; and providing a second unequal division, different from the first unequal division, when the output voltage is at a higher voltage level.

21. The method according to claim 19, wherein:

the input transistor has a shorter gate length than the cascode transistor, and/or the input transistor has a thin gate oxide layer and the cascode transistor has a thick gate oxide layer.

* * * * *